US007872419B2

(12) United States Patent
Lee

(10) Patent No.: US 7,872,419 B2
(45) Date of Patent: Jan. 18, 2011

(54) PLASMA DISPLAY PANEL CAPABLE OF REDUCING THE DEFECT RATE OF A DIELECTRIC LAYER AND METHOD OF MANUFACTURING THE SAME

(75) Inventor: Hyo-Suk Lee, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 1042 days.

(21) Appl. No.: 11/652,777

(22) Filed: Jan. 12, 2007

(65) Prior Publication Data

US 2007/0228954 A1 Oct. 4, 2007

(30) Foreign Application Priority Data

Mar. 31, 2006 (KR) ..... 10-2006-0029718

(51) Int. Cl.
*H01J 17/49* (2006.01)

(52) U.S. Cl. ..... 313/586; 313/587

(58) Field of Classification Search ..... 313/582–587; 445/23–25

See application file for complete search history.

(56) References Cited

U.S. PATENT DOCUMENTS 6,339,292 B1 * 1/2002 Ha ..... 313/582
2007/0278956 A1 * 12/2007 Harada ..... 313/582

* cited by examiner

*Primary Examiner*—Joseph L Williams
(74) *Attorney, Agent, or Firm*—Knobbe Martens Olson & Bear LLP

(57) ABSTRACT

A plasma display panel (PDP) capable of reducing the defect rate of a dielectric layer is provided. The PDP includes a first substrate, a second substrate spaced from the first substrate by a predetermined distance, a barrier rib structure disposed between the first and second substrates and defining discharge cells in cooperation with the first and second substrates, sustain electrodes arranged between the first and second substrates, a first dielectric layer covering the sustain electrodes, a phosphor layer arranged within the discharge cells, a frit disposed on edges of the first and second substrates between the first and second substrates, and a discharge gas arranged within the discharge cells, wherein at least portions of corners of the first dielectric layer are curved toward the center of the first dielectric layer so as not to contact the frit.

21 Claims, 5 Drawing Sheets

100
170
180
111
110
112
120
161
195
191c
190
191b
191a
191

PLASMA DISPLAY PANEL CAPABLE OF REDUCING THE DEFECT RATE OF A DIELECTRIC LAYER AND METHOD OF MANUFACTURING THE SAME

CROSS-REFERENCE TO RELATED APPLICATIONS

This application claims the benefit of Korean Patent Application No. 10-2006-0029718, filed on Mar. 31, 2006, in the Korean Intellectual Property Office, the disclosure of which is incorporated herein in its entirety by reference.

BACKGROUND OF THE INVENTION

1. Field of the Invention

The present embodiments relate to a plasma display panel, and more particularly, to a plasma display panel capable of reducing the defect rate of a dielectric layer.

2. Description of the Related Art

Plasma display panels (PDPs), which are being recently spotlighted as a replacement for conventional cathode ray tube (CRT), are display devices that display images by applying a discharge voltage to a discharge gas between two substrates with a plurality of electrodes formed on the substrates to generate ultraviolet (UV) rays, and exciting a phosphor material having a predetermined pattern with the UV rays.

Typical alternating current (AC) PDPs include a front substrate, a rear substrate, a plurality of discharge electrodes, a dielectric layer in which the discharge electrodes are buried, barrier ribs that define discharge cells, and a frit with which the front substrate and the rear substrate are sealed together.

FIG. 1 is a schematic plan view of a rear substrate of a conventional AC PDP. For convenience of explanation, illustration of barrier ribs is omitted.

As illustrated in FIG. 1, a dielectric layer 11 formed on a rear substrate 10 extends to over the edges of the rear substrate 10. Corners 11*a* of the dielectric layer 11 are buried in a frit 12.

In other words, the frit 12 is located on the edges of the rear substrate 10 and a front substrate (not shown) in order to seal the rear substrate 10 and the front substrate. Since the corners 11*a* of the dielectric layer 11 are angled toward the outside of the rear substrate 10, they are located at positions where the frit 12 is coated. Hence, the corners 11*a* are buried in the frit 12.

After the coating of the frit 12 and an assembly of the rear substrate 10 and the front substrate, a baking process is required to attach the rear substrate 10 and the front substrate together. Since the baking process is performed at high temperature, deformation of the rear substrate 10, the front substrate, the dielectric layer 11, and the frit 12 usually occur.

However, in most cases, the dielectric layer 11 and the frit 12 have different thermal expansion coefficients. Hence, different degrees of thermal expansions of the dielectric layer 11 and the frit 12 attached to each other during the baking process create many thermal stresses.

When many thermal stresses are generated as described above, the dielectric layer 11 can be peeled, cracked, or broken during the baking process. This increases the defect rate of the dielectric layer 11. Although the dielectric layer 11 does not directly fail during the baking, the dielectric layer 11 becomes weak against external vibrations and impacts due to residual stresses.

SUMMARY OF THE INVENTION

The present embodiments provide a plasma display panel (PDP) capable of reducing the defect rate of a dielectric layer.

According to an aspect of the present embodiments, there is provided a PDP including a first substrate, a second substrate spaced from the first substrate by a predetermined distance, a barrier rib structure disposed between the first and second substrates and defining discharge cells in cooperation with the first and second substrates, sustain electrodes arranged between the first and second substrates, a first dielectric layer covering the sustain electrodes, a phosphor layer arranged within the discharge cells, a frit disposed on edges of the first and second substrates between the first and second substrates, and a discharge gas arranged within the discharge cells, wherein at least portions of corners of the first dielectric layer are curved toward the center of the first dielectric layer so as not to contact the frit.

The plasma display panel may further comprise address electrodes intersecting the sustain electrodes, and a second dielectric layer covering the address electrodes.

At least portions of corners of the second dielectric layer may be curved toward the center of the second dielectric layer so as not to contact the frit.

Each of the corners of the second dielectric layer may comprise a first surface and a second surface that makes a predetermined angle with the first surface.

The predetermined angle may be a substantially right angle.

A first corner portion created where the first and second surfaces meet may not contact the frit.

Each of the corners of the second dielectric layer may have a shape of a circular arc having a predetermined curvature.

Each of the corners of the first dielectric layer may comprise a third surface and a fourth surface that makes a predetermined angle with the third surface.

The predetermined angle may be a substantially right angle.

A second corner portion created where the third and fourth surfaces meet may not contact the frit.

Each of the corners of the first dielectric layer may have a shape of a circular arc having a predetermined curvature.

According to another aspect of the present embodiments, there is provided a plasma display panel comprising: a first substrate; a second substrate spaced from the first substrate by a predetermined distance; a barrier rib structure disposed between the first and second substrates and defining discharge cells in cooperation with the first and second substrates; sustain electrodes arranged between the first and second substrates; a first dielectric layer covering the sustain electrodes; address electrodes intersecting the sustain electrodes; a second dielectric layer covering the address electrodes; a phosphor layer arranged within the discharge cells; a frit disposed on edges of the first and second substrates between the first and second substrates; and a discharge gas arranged within the discharge cells, wherein at least portions of corners of the second dielectric layer are curved toward the center of the second dielectric layer so as not to contact the frit.

Each of the corners of the second dielectric layer may comprise a first surface and a second surface that makes a predetermined angle with the first surface.

The predetermined angle may be a substantially right angle.

A first corner portion created where the first and second surfaces meet may not contact the frit.

Each of the corners of the second dielectric layer may have a shape of a circular arc having a predetermined curvature.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings, in which exemplary embodiments are shown.

Figure 1:
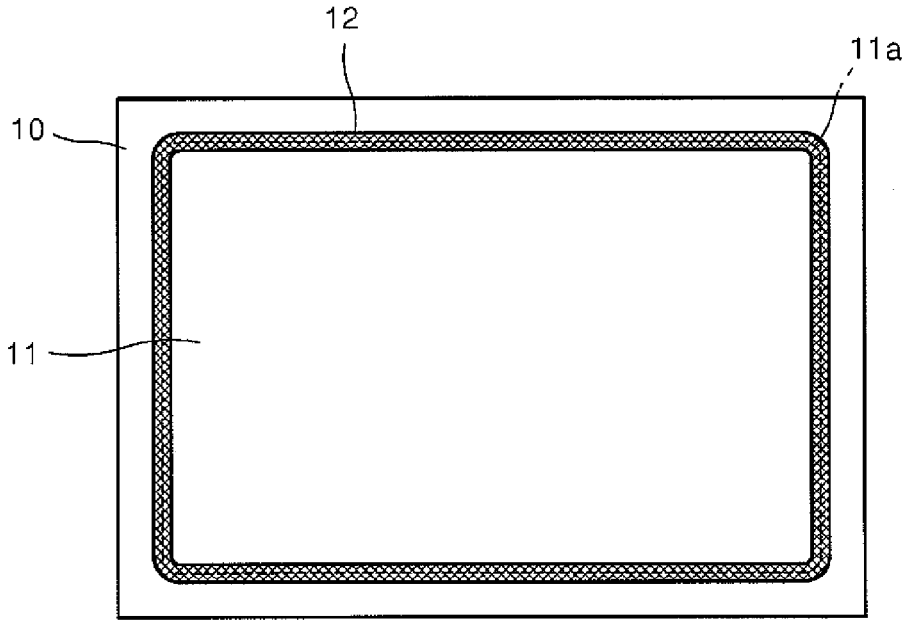
FIG. 1 (PRIOR ART)
FIG. 1 is a schematic plan view of a rear substrate of a conventional AC PDP.
Figure 2:
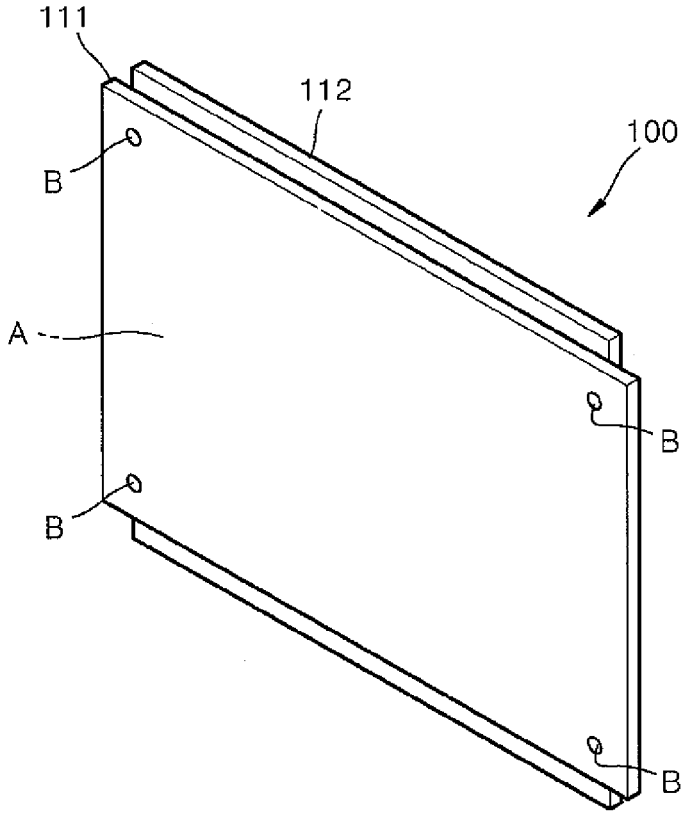
FIG. 2 is a schematic perspective view of a PDP according to an embodiment.

FIG. 2 is a schematic perspective view of a PDP 100 according to an embodiments. As illustrated in FIG. 2, the PDP 100 includes a first substrate 111 displaying an image and a second substrate 112 arranged at the rear of the first substrate 111.

In FIG. 2, a portion A denotes a display region of the PDP 100 that transmits generated visible light and displays an image, and portions B denote corner regions of the PDP 100 where corners of a dielectric layer and frit are located.

The display region of the PDP 100 will now be described with reference to FIG. 3, and the corner regions of the PDP 100 will now be described with reference to FIGS. 4 and 5.

Figure 3:
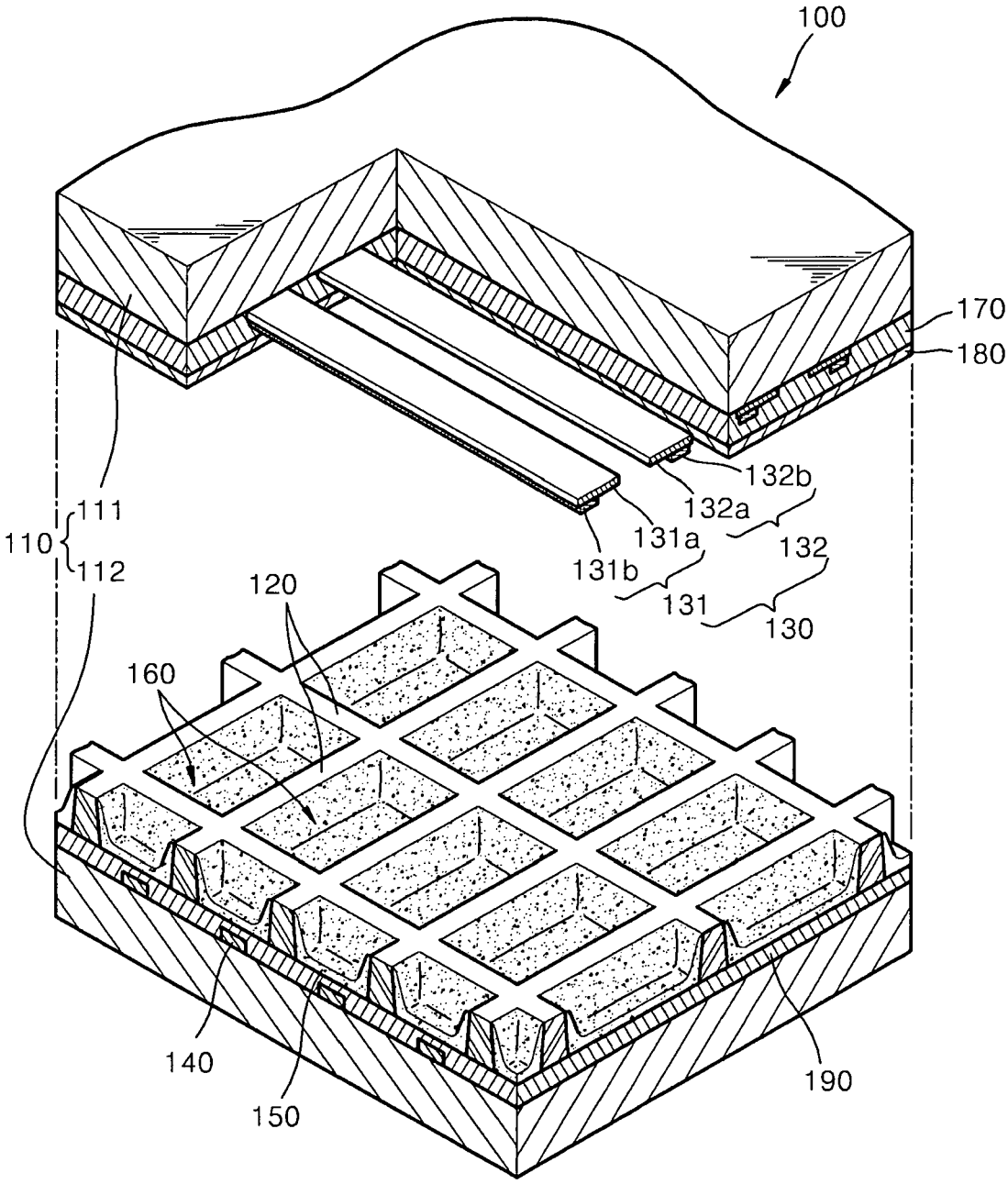
FIG. 3 is a cut-away schematic perspective view of a display region of the PDP of FIG. 2.

FIG. 3 is a cut-away schematic perspective view of the display region of the PDP 100. As illustrated in FIG. 3, the display region of the PDP 100 includes a substrate pair 110, a barrier rib structure 120, sustain electrodes 130, address electrodes 140, and phosphor layers 150.

The substrate pair 110 includes the first substrate 111 and the second substrate 112. The first substrate 111 and the second substrate 112 are spaced from each other by a predetermined distance and face each other. The first substrate 111 can be made of a transparent material such as, for example, glass and transmits visible light.

In this embodiment, the first substrate 111 is transparent and accordingly transmits visible light generated by discharge. However, the present embodiments are not limited to this embodiment. In other words, both the first and second substrates 111 and 112 may be transparent. Alternatively, the first and second substrates 111 and 112 may be semi-transparent and include color filters formed on or inside the first and second substrates.

The barrier rib structure 120 is disposed between the first and second substrates 111 and 112, and keeps a discharge distance and defines discharge spaces together with the sustain electrodes 130 to form discharge cells 160. The barrier rib structure 120 prevents electrical, and/or optical cross-talk between discharge cells 160.

Although the discharge cells 160 having rectangular horizontal cross-section are illustrated in this embodiment, the present embodiments are not limited to this cross-section shape. The horizontal cross-section of each of the discharge cells 160 may be polygonal (e.g., triangular, pentagonal, etc.), circular, or oval. The barrier rib structure 120 may be a striped pattern, for example, it may be of an open type.

The sustain electrodes 130 include first electrodes 131 and second electrodes 132, one of which serve as common electrodes and the other serve as scan electrodes.

The first and second electrodes 131 and 132 include transparent electrodes 131*a* and 132*a*, respectively, and bus electrodes 131*b* and 132*b*, respectively. The electrodes 131*a*, 131*b*, 132*a*, and 132*b* have a stripe shape.

The transparent electrodes 131*a* and 132*a* are made of indium tin oxide (ITO) and arranged on a rear surface of the first substrate 111 and transmit visible light.

The bus electrodes 131*b* and 132*b* are installed on bottom surfaces of the transparent electrodes 131*a* and 132*a*, respectively. To reduce the line resistances of the transparent electrodes 131*a* and 132*a*, the bus electrodes 131*b* and 132*b* are made of metal having high electric conductivity, such as, silver (Ag), copper (Cu), or aluminum (Al), and have small widths.

Although the first and second electrodes 131 and 132 having the ITO transparent electrodes 131*a* and 132*a* are illustrated in the present embodiment, the present embodiments are not limited thereby. For example, the first and second electrodes 131 and 132 may include bus electrodes made of an opaque material, such as, silver (Ag), copper (Cu), or aluminum (Al). In this case, in order to increase the transmissivity of visible light, each of the first and second electrodes 131 and 132 is preferably divided into several narrow lines so that light pass through spaces between the narrow lines.

A first dielectric layer 170, in which the first and second electrodes 131 and 132 are buried, is formed on the first substrate 111.

The first dielectric layer 170 can prevent direct electrical conduction between the sustain electrodes 130 from occurring during sustain discharge and can also prevent charged particles from directly colliding with the sustain electrodes 130 and destroying them, and also can induce the charged particles and accumulate wall charges. To achieve this, the first dielectric layer 170 can be formed of PbO, $B_2O_3$, $SiO_2$, etc.

A protection layer 180 is formed on the bottom surface of the first dielectric layer 170 and can be made of, for example, magnesium oxide (MgO). The protection layer 180 prevents the sustain electrodes 130 from being destroyed due to sputtering of plasma particles, and emits secondary electrons to lower the discharge voltage.

Address electrodes 140 extend across the second substrate 112 and intersect the sustain electrodes 130.

The address electrodes 140 are in the shape of a stripe and executes address discharge in cooperation with electrodes of the sustain electrodes 130 on the first substrate 111 that serve as scan electrodes.

A second dielectric layer 190, in which the address electrodes 140 are buried, is formed on the second substrate 112 and protects the address electrodes 140 and induces formation of wall charges.

Phosphor materials that emit blue, green, and red visible lights are coated on portions of the upper surface of the second dielectric layer 190 that correspond to bottom surfaces of the discharge cells 160 and on lateral surfaces of the barrier rib structure 120, thereby forming the phosphor layers 150.

The phosphor layers 150 are classified into blue phosphor layers, green phosphor layers, and red phosphor layers according to the color of visible light emitted. The blue phosphor layers are arranged in lines, and likewise for the green phosphor layers and the red phosphor layers.

The phosphor layers 150 receive UV light and emit visible light. The blue phosphor layers 150 may be formed by coating with $BaMgAl_{10}O_{17}$:Eu, the green phosphor layers 150 may be formed by coating with $Zn_2SiO_4$:Mn, and the red phosphor layers 150 may be formed by coating with $Y(V,P)O_4$:Eu.

Figure 4:
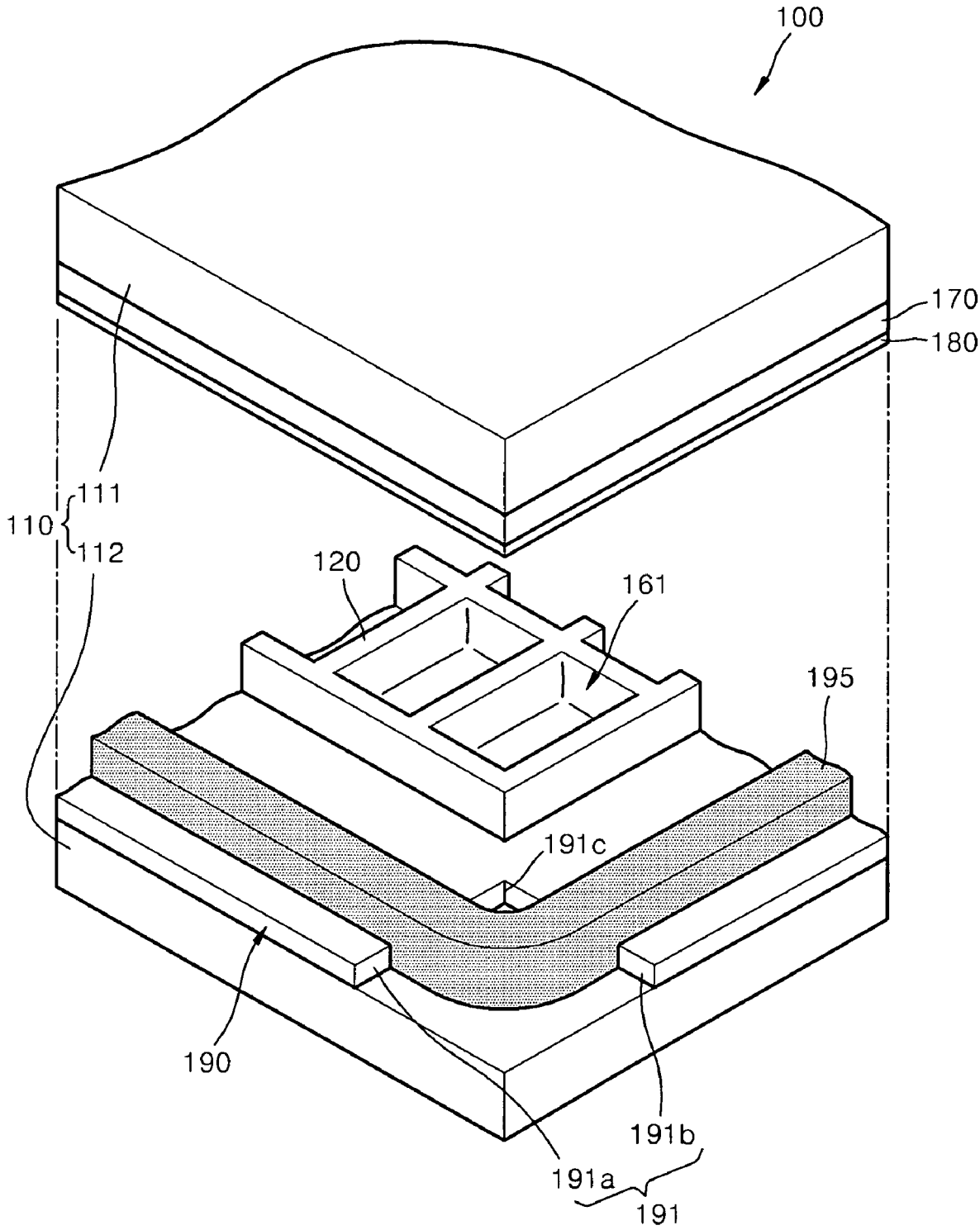
FIG. 4 is a cut-away schematic perspective view of a corner region of the PDP of FIG. 2.
Figure 5:
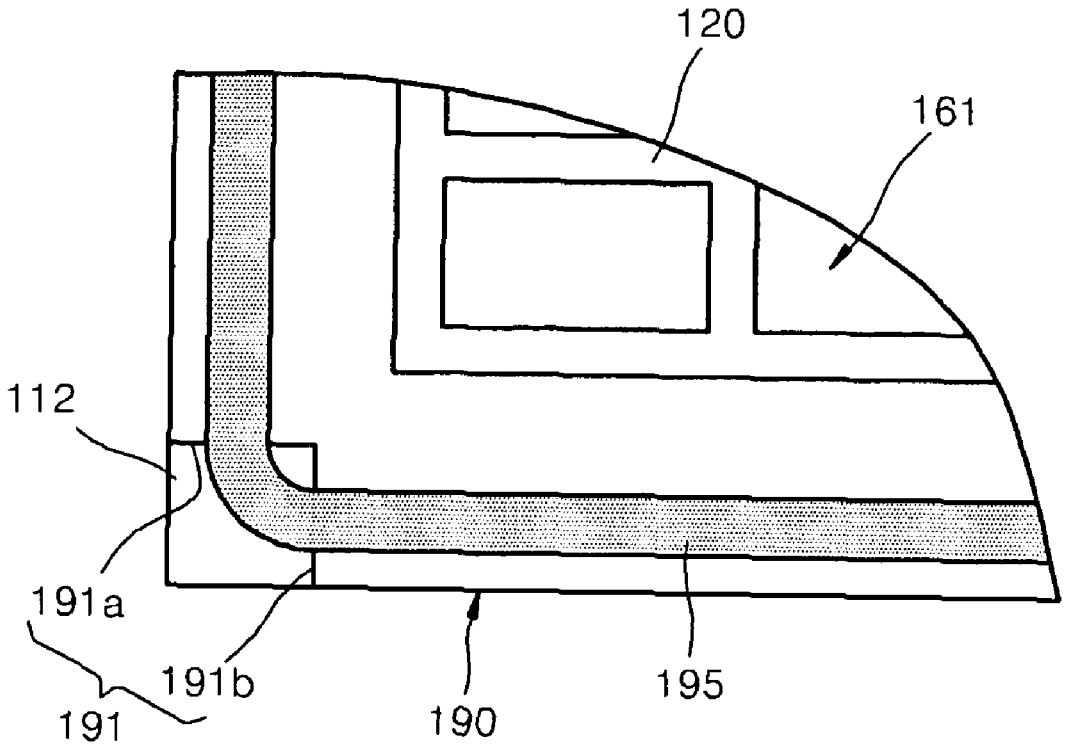
FIG. 5 is a schematic plan view of a second dielectric layer illustrated in FIG. 4.

The first and second substrates 111 and 112 are sealed together by a frit 195 shown in FIG. 4. The frit 195 is formed along the edges of the first and second substrates 111 and 112.

The PDP 100 enclosed by sealing the first and second substrates 111 and 112 is fully filled with the air. Accordingly, the air is completely discharged from the PDP 100 and is replaced by a proper amount of discharge gas enough to increase the efficiency of discharge. A gas mixture, such as, Ne—Xe, He—Xe, or He—Ne—Xe, is frequently used as the discharge gas, but the present embodiments are not limited thereto.

The corner regions of the PDP 100 will now be described with reference to FIGS. 4 and 5.

FIG. 4 is a cut-away schematic perspective view of a corner region of the PDP 100. FIG. 5 is a schematic plan view of the second dielectric layer 190 illustrated in FIG. 4.

In the corner regions of the PDP 100, the frit 195 is formed. Discharge cells near the corner regions are dummy discharge cells 161 where discharge does not occur.

In the present embodiment, corner portions 191 of the second dielectric layer 190 have different shapes from the corner portions of the first dielectric layer 170. In other words, the corner portions of the first dielectric layer 170 are angled outward, whereas the corner portions 191 of the second dielectric layer 190 are angled toward the center of the second dielectric layer 190. A rectangular plate having a predetermined thickness is prepared as the second dielectric layer 190, and corner portions of the rectangular plate are cut off, whereby the second dielectric layer 190 has the corners 191 angled toward the center of the second dielectric layer.

Some inner portions of the corners 191 of the second dielectric layer 190 do not contact the frit 195. Each of the corners 191 of the second dielectric layer 190 includes a first surface 191*a* and a second surface 191*b* that make a substantially right angle. A first corner portion 191*c* formed at a point where the first and second surfaces 191*a* and 191*b* meet does not directly contact the frit 195.

Although the first and second surfaces 191*a* and 191*b* making a substantially right angle are illustrated in the present embodiment, the present embodiments are not limited thereto. There are no limits to the angle created where the first and second surfaces 191*a* and 191*b* are disposed. However, it is preferable that the angle created where the first and second first and second surfaces 191*a* and 191*b* is set to be from about 90° and about 150° in order to prevent stresses from being experienced due to an abrupt change in the shape of the second dielectric layer 190.

In the present embodiment, the second dielectric layer 190 is formed by forming a rectangular plate on the second substrate 112 and cutting off corner portions of the rectangular plate. However, the present embodiments are not limited to this manufacturing process. In other words, the second dielectric layer 190 may be patterned to have a corner angled toward the center of the second dielectric layer, before being stacked on the second substrate 112.

Although the corners 191 of the second dielectric layer 190 according to the present embodiment include the first surface 191*a*, the second surface 191*b*, and the first corner portion 191*c*, the present embodiments are not limited to this configuration. In other words, each of the corners 191 of the second dielectric layer 190 may include no corner portions, that is, they may be made up of a single surface having a predetermined curvature.

In the present embodiment, only the second dielectric layer 190 has the corner portions 191 angled toward the center of the second dielectric layer, for example, the center of the PDP 100, that is, the first dielectric layer 170 can have no corner portions angled toward the center of the PDP 100. However, the present embodiments are not limited to this structure.

In one embodiment, only the first dielectric layer 170 has corner portions angled toward the center of the PDP 100. Alternatively, both the first and second dielectric layers 170 and 190 may have corner portions angled toward the center of the PDP 100. When the first dielectric layer 170 has corner portions angled toward the center of the PDP 100, each corner portion of the first dielectric layer 170 may have a third surface, a fourth surface that makes a predetermined angle with the third surface, and a second corner portion created where the third and fourth surfaces join together. The third surface corresponds to the first surface 191*a*, the fourth surface corresponds to the second surface 191*b*, and the second corner portion corresponds to the first corner portion 191*c*.

As described above, the frit 195 is formed between the first and second substrates 111 and 112 to have the shape illustrated in FIG. 4, and is baked to attach the first and second substrates 111 and 112 to each other. In the corners of the PDP 100, the frit 195 directly contacts the second substrate 112 and the protection layer 180 because of the shape of the corners 191. In the other regions of the PDP 100, the frit 195 directly contacts the second dielectric layer 190 and the protection layer 180.

As described above, in the present embodiment, the corners 191 of the second dielectric layer 190 are angled toward the center of the second dielectric layer so that a portion of the second dielectric layer 190 does not contact the frit 195. In particular, the first corner portion 191*c* where stresses are anticipated to be collected due to a shape change is separated from the frit 195. Hence, thermal stresses are prevented from being generated due to different thermal expansion rates between the second dielectric layer 190 and the frit 195 during sealing, whereby the second dielectric layer 190 is prevented from being peeled or broken. Furthermore, residual stresses operating after the sealing are prevented, such that the second dielectric layer 190 is prevented from being peeled or broken.

An operation of the PDP 100 will now be described in greater detail.

When a predetermined external address voltage is applied to electrodes of the sustain electrodes that serve as scan electrodes and to the address electrodes 140 after assembling the PDP 100 and injecting a discharge gas thereinto, address discharge occurs. As a result of the address discharge, discharge cells 160 (see FIG. 3) where sustain discharge is to occur are selected.

Thereafter, when a sustain discharge voltage is applied to some of the sustain electrodes 130 that correspond to the selected discharge cells 160, sustain discharge occurs due to a motion of wall charges. While the energy level of the discharge gas excited during sustain discharge is decreasing, UV light is emitted.

The UV light excites the phosphor layers 150 coated within the discharge cells 160. While the energy level of the excited phosphor layers 150 is decreasing, visible light is emitted. While being emitted via the first substrate 111, the visible light forms an image that a user can view.

In the present embodiment, a portion of the second dielectric layer 190 is angled toward the center of the second dielectric layer so as to be prevented from contacting the frit 195. Hence, failures of the second dielectric layer 190 during the sealing process can be prevented.

A modification of the embodiment illustrated in FIG. 2 will now be described with reference to FIG. 6, by focusing on different features from the embodiment of FIG. 2.

Figure 6:
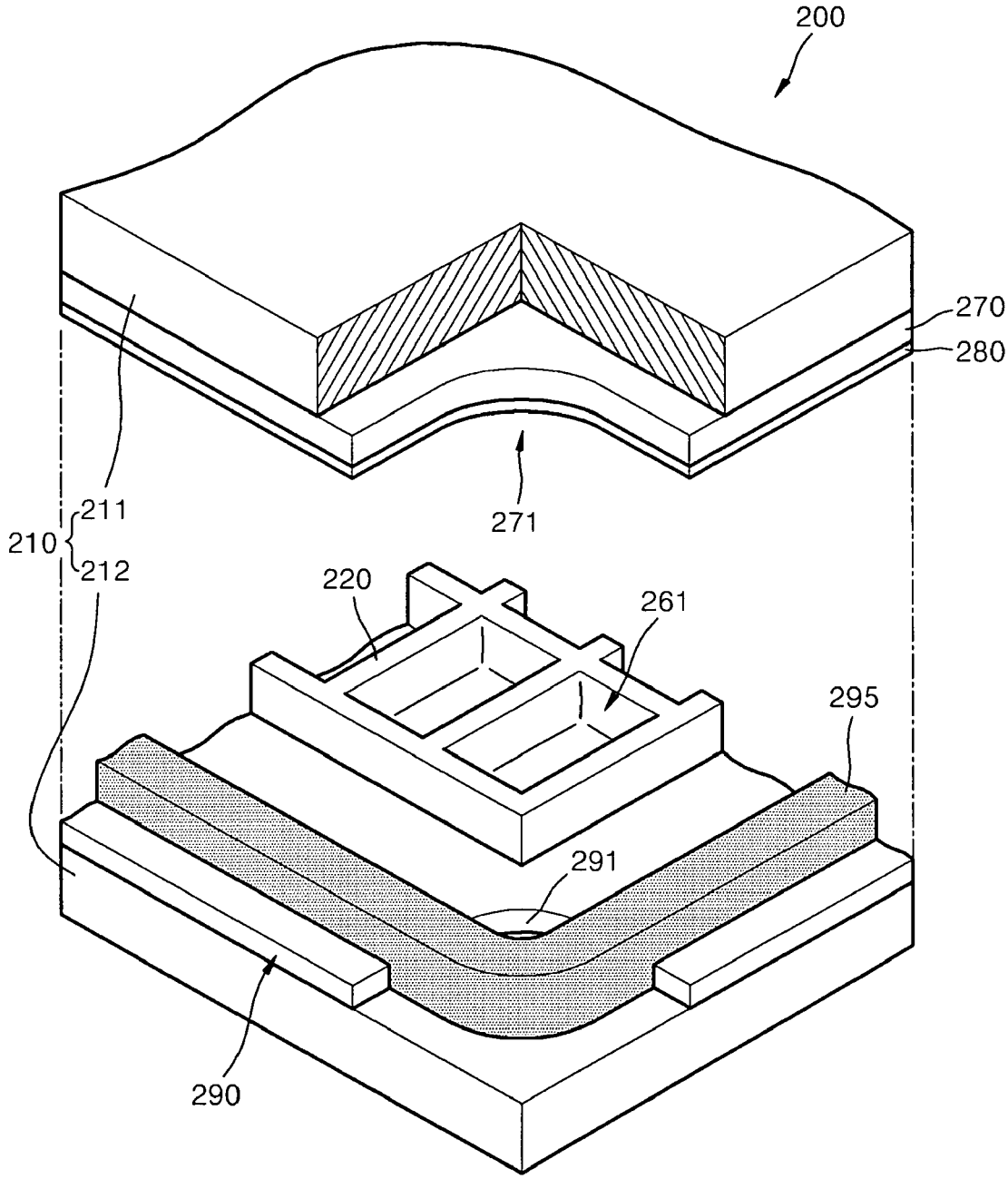
FIG. 6 is a cut-away schematic perspective view of a corner region of a PDP according to a modification of the embodiment illustrated in FIG. 2.

FIG. 6 is a cut-away schematic perspective view of a corner region of a PDP 200 according to a modification of the embodiment of FIG. 2. As illustrated in FIG. 6, corner portions of the PDP 200 include a substrate pair 210, a barrier rib structure 220, dummy discharge cells 261, a first dielectric layer 270, a protection layer 280, a second dielectric layer 290, and a frit 295.

Each corner 271 of the first dielectric layer 270 is shaped of a circular arc having a predetermined curvature. Each corner 291 of the second dielectric layer 290 is also shaped of a circular arc with a predetermined curvature so as to match with the shape of the corners 271 of the first dielectric layer 270.

The predetermined curvature is determined so that each corner 271 of the first dielectric layer 270 is so smoothly curved as to minimize stress concentration and ensure that inner portions of the corners 271 and 291 where stresses are concentrated do not contact the frit 295.

In other words, in this modified embodiment, not only the corners 291 of the second dielectric layer 290 but also the corners 271 of the first dielectric layer 270 are curved toward the center of the PDP 200 to have circular arc shapes. Hence, the first dielectric layer 270 can be prevented from being peeled or broken.

In this modified embodiment, since inward portions of the corners 271 and 291 of the first and second dielectric layers 270 and 290 do not contact the frit 295, thermal stresses are prevented from being generated due to different thermal expansion rates between the first and second dielectric layers 270 and 290 and the frit 295 during a high-temperature sealing process. The first and second dielectric layers 270 and 290 are also prevented from being peeled or broken. Furthermore, residual stresses operating even after the sealing process are prevented, whereby the peeling or breaking of the first and second dielectric layers 270 and 290 are continuously prevented.

In addition, in this modified embodiment, the corners 271 and 291 of the first and second dielectric layers 270 and 290 have shapes of a circular arc with a predetermined curvature so as to properly distribute generated thermal stresses. Hence, the stress concentration is further reduced.

Structures, operations, and effects of the PDP 200 other than the above-described structures, operations, and effects are the same as those of the PDP 100, so descriptions thereof will be omitted.

As described above, a PDP according to the present embodiments are designed so that a portion of each corner of a dielectric layer where stresses are apt to concentrate does not contact a frit. Therefore, even when an external impact exerts on the dielectric layer while or after substrate sealing, the dielectric layer can be prevented from being peeled off or broken.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising:

a first substrate;

a second substrate spaced from the first substrate by a predetermined distance;

a barrier rib structure disposed between the first and second substrates and defining discharge cells in cooperation with the first and second substrates;

sustain electrodes arranged between the first and second substrates;

a first dielectric layer covering the sustain electrodes;

a phosphor layer within the discharge cells;

a frit disposed on edges of the first and second substrates between the first and second substrates; and a discharge gas within the discharge cells, wherein at least portions of corners of the first dielectric layer are curved toward the center of the first dielectric layer so as not to contact the frit.

2. The plasma display panel of claim 1, further comprising:

address electrodes intersecting the sustain electrodes; and a second dielectric layer covering the address electrodes.

3. The plasma display panel of claim 2, wherein at least portions of corners of the second dielectric layer are curved toward the center of the second dielectric layer so as not to contact the frit.

4. The plasma display panel of claim 3, wherein each of the corners of the second dielectric layer comprises a first surface and a second surface that makes a predetermined angle with the first surface.

5. The plasma display panel of claim 4, wherein the predetermined angle is a substantially right angle.

6. The plasma display panel of claim 4, wherein the predetermined angle is from about 90° to about 150°.

7. The plasma display panel of claim 4, wherein a first corner portion created where the first and second surfaces meet does not contact the frit.

8. The plasma display panel of claim 3, wherein each of the corners of the second dielectric layer has a shape of a circular arc having a predetermined curvature.

9. The plasma display panel of claim 1, wherein each of the corners of the first dielectric layer comprises a third surface and a fourth surface that makes a predetermined angle with the third surface.

10. The plasma display panel of claim 9, wherein the predetermined angle is a substantially right angle.

11. The plasma display panel of claim 9, wherein the predetermined angle is from about 90° to about 150°.

12. The plasma display panel of claim 8, wherein a second corner portion created where the third and fourth surfaces meet does not contact the frit.

13. The plasma display panel of claim 1, wherein each of the corners of the first dielectric layer has a shape of a circular arc having a predetermined curvature.

14. A plasma display panel comprising:

a first substrate;

a second substrate spaced from the first substrate by a predetermined distance;

a barrier rib structure disposed between the first and second substrates and defining discharge cells with the first and second substrates;

sustain electrodes arranged between the first and second substrates;

a first dielectric layer covering the sustain electrodes;

address electrodes intersecting the sustain electrodes;

a second dielectric layer covering the address electrodes;

a phosphor layer arranged within the discharge cells;

a frit disposed on edges of the first and second substrates between the first and second substrates; and a discharge gas within the discharge cells, wherein at least portions of corners of the second dielectric layer are curved toward the center of the second dielectric layer so as not to contact the frit.

15. The plasma display panel of claim 14, wherein each of the corners of the second dielectric layer comprises a first surface and a second surface that makes a predetermined angle with the first surface.

16. The plasma display panel of claim 15, wherein the predetermined angle is a substantially right angle.

17. The plasma display panel of claim 15, wherein the predetermined angle is from about 90° to about 150°.

18. The plasma display panel of claim 15, wherein a first corner portion created where the first and second surfaces meet does not contact the frit.

19. The plasma display panel of claim 14, wherein each of the corners of the second dielectric layer has a shape of a circular arc having a predetermined curvature.

20. A method of manufacturing the plasma display panel of claim 1, comprising forming at least one dielectric layer by forming a rectangular plate on at least one substrate; and cutting off corner portions of the rectangular plate.

21. A method of manufacturing the plasma display panel of claim 14, comprising forming at least one dielectric layer by forming a rectangular plate on at least one substrate; and cutting off corner portions of the rectangular plate.

* * * * *